US008661920B2

(12) United States Patent
Molitor et al.

(10) Patent No.: US 8,661,920 B2
(45) Date of Patent: Mar. 4, 2014

(54) HANDHELD PIPETTING APPARATUS

(75) Inventors: Peter Molitor, Hamburg (DE); Karl-Friedrich Andres, Bargteheide (DE); Steffen Hofmann, Hamburg (DE); Heinz-Gerhard Köhn, Hamburg (DE)

(73) Assignee: Eppendorf AG, Hamburg (DE)

( * ) Notice: Subject to any disclaimer, the term of this patent is extended or adjusted under 35 U.S.C. 154(b) by 700 days.

(21) Appl. No.: 12/887,950

(22) Filed: Sep. 22, 2010

(65) Prior Publication Data

US 2011/0072915 A1 Mar. 31, 2011

Related U.S. Application Data

(63) Continuation of application No. 12/161,077, filed as application No. PCT/EP2008/001670 on Mar. 3, 2008, now abandoned.

(30) Foreign Application Priority Data

Mar. 2, 2007 (DE) ..... 10 2007 010 299

(51) Int. Cl.
*B01L 3/02* (2006.01)
*G06F 3/02* (2006.01)

(52) U.S. Cl.
CPC ..... *B01L 3/0279* (2013.01); *B01L 3/0237* (2013.01); *B01L 3/0217* (2013.01); *B01L 2200/023* (2013.01)
USPC ..... 73/864.14; 73/863.02; 73/864.16

(58) Field of Classification Search
CPC ... B01L 3/0217; B01L 3/0237; B01L 3/0279; B01L 3/02; B01L 2200/023; G01F 11/04; G01N 31/16; G06F 3/02
USPC ..... 73/1.74, 863.01–863.03, 863.32, 73/864.13–864.14, 864.16–864.17; 345/168; 422/525
See application file for complete search history.

(56) References Cited

U.S. PATENT DOCUMENTS 3,982,899 A * 9/1976 Kelm ..... 73/864.18
3,991,616 A * 11/1976 Stahli ..... 73/863.32

(Continued)

FOREIGN PATENT DOCUMENTS

DE 2926691 6/1981
DE 4341229 6/1995

(Continued)

OTHER PUBLICATIONS

IPRP for PCT/EP2008/001670 mailed Mar. 7, 2008.*

*Primary Examiner* — Thomas P Noland
(74) *Attorney, Agent, or Firm* — Vidas, Arrett & Steinkraus

(57) ABSTRACT

A handheld pipetting apparatus for metering liquids, with a handleable pipette housing, at least one accommodation for a fastening portion of a syringe cylinder of a syringe, at least one plunger accommodation in an accommodation body for a plunger fastening portion of a syringe plunger of the syringe, syringe and plunger gripping levers for detachably holding the fastening portion in the accommodation and the plunger fastening portion in the plunger accommodation, at least one displacement device with a displacement chamber and a shiftable chamber wall limiting the same, for displacing a fluid; at least one seat for detachably holding a pipette point, a channel, connecting a hole in the seat with a displacement chamber, and at least one drive device, which is connected to couplable with the accommodation body the and/or the chamber wall, for shifting the accommodation body with respect to the accommodation, the and/or the chamber wall with respect to the displacement chamber.

18 Claims, 7 Drawing Sheets

(56) References Cited

U.S. PATENT DOCUMENTS

Figure 1:
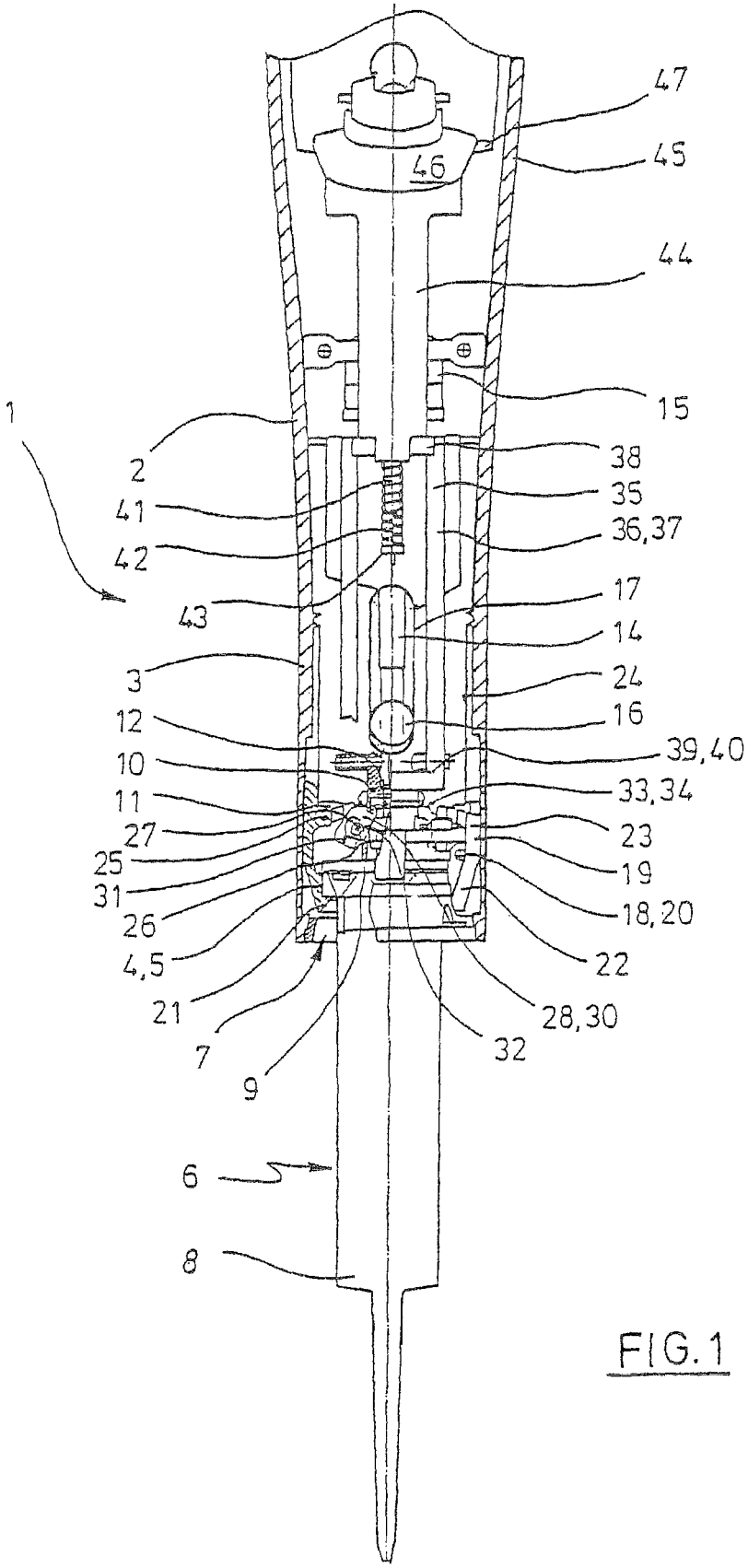

| | | | | |
|---|---|---|---|---|
| 5,620,660 | A * | 4/1997 | Belgardt et al. | 422/525 |
| 5,620,661 | A * | 4/1997 | Sch urbrock | 422/525 |
| 6,090,348 | A * | 7/2000 | Steele et al. | 422/525 X |
| 6,540,964 | B2 * | 4/2003 | Kohrmann et al. | 73/863.32 X |
| 6,778,917 | B1 * | 8/2004 | Jansen | 702/45 |
| 2004/0105784 | A1 * | 6/2004 | Fukuju et al. | B01L 3/02 |
| 2005/0232819 | A1 * | 10/2005 | Jagdhuber | 422/561 |
| 2006/0051252 | A1 * | 3/2006 | Yuan et al. | B01L 3/0217 |
| 2006/0263261 | A1 * | 11/2006 | Lenz | 422/525 |
| 2009/0139351 | A1 * | 6/2009 | Reichmuth et al. | B01L 3/0279 |
| 2012/0003129 | A1 * | 1/2012 | Rempt et al. | B01L 3/0217 |

FOREIGN PATENT DOCUMENTS

| | | | | |
|---|---|---|---|---|
| DE | 3588071 | | 6/1996 | |
| DE | 10238564 | | 3/2004 | |
| DE | 102005023203 | | 11/2006 | |
| DE | 102006009816.1 | | 9/2007 | |
| EP | 0562358 | | 9/1993 | |
| EP | 603076 | A1 * | 6/1994 | B01L 3/02 |
| EP | 0657216 | | 6/1995 | |
| EP | 801309 | A2 * | 10/1997 | B01L 3/02 |
| EP | 1469068 | A1 * | 10/2004 | B01L 3/02 |
| EP | 1524035 | A1 * | 4/2005 | B01L 3/02 |

* cited by examiner

HANDHELD PIPETTING APPARATUS

CROSS-REFERENCE TO RELATED APPLICATIONS

This application is a Continuation of application Ser. No. 12/161,077, filed Jul. 16, 2008, which is a national stage of PCT/EP2008/001670, filed Mar. 3, 2008, which claims priority to DE 10 2007 010 299.4, filed Mar. 2, 2007, the entire contents of each of which are hereby incorporated by reference.

STATEMENT REGARDING FEDERALLY SPONSORED RESEARCH

Not applicable.

BACKGROUND OF THE INVENTION

The present invention is related to a handheld pipetting apparatus for metering liquids.

Handheld pipetting apparatuses or pipettes, respectively, are handleable metering apparatuses, which are used in the laboratory for metering liquids in particular.

Air cushion pipettes have a seat for detachably holding a pipette point. A displacement device for a gas is integrated into the pipette and communicatingly connected with the pipette point through a hole in the seat via a channel. An air cushion is displaced by means of the displacement device, so that liquid is aspirated through a point opening of the pipette point and ejected from it according to the direction of the displacement of the air cushion. Mostly, the displacement equipment is a cylinder with a plunger shiftable therein. The plunger is driven by means of a drive device.

Direct displacement pipettes co-operate with syringes, which have a syringe cylinder and a syringe plunger shiftable therein. The syringes can be coupled with the direct displacement pipettes and they are detachable from them. In this, the syringe cylinder is held on the direct displacement pipette and the syringe plunger is held on an accommodation body, which is shiftable by means of a drive device. By means of the drive device, the syringe plunger is moved to and from, so that liquid is aspirated through a hole of the syringe or ejected from the same, respectively.

Preferably, the pipette points or syringes, respectively, are made of plastic material and can be discarded after use or be replaced by a new pipette point or syringe ("single use article").

Air cushion pipettes and direct displacement pipettes with manual and with electro-mechanical drive devices are known. In addition, there are air cushion pipettes and direct displacement pipettes with fixed volume and with adjustable volume. Further, there are single channel pipettes for the use with only one single pipette point or syringe, and multichannel pipettes for simultaneous use of a plurality thereof.

Advantages of air cushion pipettes with respect to direct displacement pipettes may be found in the greater metering accuracy at small amounts of liquid and when working with liquids having low vapour pressure or low viscosity, respectively. Further, in the smaller force required for actuation and the lower cost of the pipette points with respect to the syringes. However, in air cushion pipettes, liquid can come into the pipette through the channel and contaminate the same. Therefore, direct displacement pipettes are used in particular when contaminations of the pipette have to be avoided. Further, direct displacement pipettes have a smaller metering error than air cushion pipettes, when liquids having a high vapour pressure (ethanol or acetone, for instance) or having a higher viscosity (for instance glycol) have to be metered.

From DE 35 88 071 T2, the entire contents of which is incorporated herein by reference, an air cushion pipette is known, which can be equipped with different displacement devices, which each have a cylinder and a plunger arranged longitudinally shiftable therein. The displacement devices have a seat for a pipette point.

From DE 43 41 229 C2, the entire contents of which is incorporated herein by reference, and DE 10 2005 023 203 A1, the entire contents of which is incorporated herein by reference, direct displacement pipettes are known which can be equipped with different syringes.

DE 102 38 564 B4, the entire contents of which is incorporated herein by reference, discloses a pipette with a displacement device executed as a membrane pump, which is executed either as an air cushion pipette or as a direct displacement pipette.

Thus, the user reverts to air cushion pipettes or to direct displacement pipettes according to the metering task, which have to be kept at hand, cleaned, maintained and calibrated in the laboratory.

Proceeding from this, the present invention is based on the objective to facilitate the use of air cushion pipettes and of direct displacement pipettes for the user.

BRIEF SUMMARY OF THE INVENTION

The handheld pipetting apparatus of the present invention has a handleable pipette housing, at least one accommodation for a fastening portion of a syringe cylinder of a syringe, at least one plunger accommodation in an accommodation body for a plunger fastening portion of a syringe plunger of the syringe, fastening means for detachably holding the fastening portion in the accommodation and the plunger fastening portion in the plunger accommodation, at least one displacement device with a displacement chamber and a shiftable chamber wall limiting the same, for displacing a fluid; at least one seat for detachably holding a pipette point, a channel, connecting a hole in the seat to a displacement chamber, and at least one drive device, which is connected to and/or couplable with the accommodation body and/or the chamber wall, for shifting the accommodation body with respect to the accommodation, and/or the chamber wall with respect to the displacement chamber.

According to the present invention, a handheld pipetting apparatus is provided for the first time, which can be equipped with syringes as well as with pipette points. For using it with syringes, the handheld pipetting apparatus has an accommodation, a plunger accommodation and fastening means for detachably holding the fastening portion and the plunger fastening portion of the syringe. For using it with pipette points, it is provided with a suitable seat. Thus, the user has the possibility to use the handheld pipetting apparatus as a direct displacement pipette or as an air cushion pipette, according to the field of application. Thus, the present invention makes it possible that the user needs only a smaller number of handheld pipetting apparatuses. Accordingly, the investment cost is reduced. The workflow in the laboratory is improved. In particular, the time expense for changing over from an air cushion pipette to a direct displacement pipette is reduced. In each metering task, the user can easily take the advantages of the air cushion pipette or of the direct displacement pipette, respectively. Further, metering of liquids is facilitated in that the user must be skilled only in working with one single handheld pipetting apparatus. The expense for cleaning, maintenance and calibration of the handheld pipetting apparatus is reduced.

The accommodation, the plunger accommodation and the fastening means are preferably executed like the accommodation, the plunger accommodation and the gripping devices according to EP 0 656 229 B1, the entire contents of which is incorporated herein by reference, the explanations of which relevant to this are incorporated into the present application by reference. Preferably, the seat is a conical and/or cylindrical attachment for clamping up a pipette point, or a blind bore for clamping in a pipette point, wherein the blind bore has the hole in the bottom which connects it to the channel.

According to a preferred embodiment, at the one side, the displacement device has an adapter housing with a fastening portion for fastening in the accommodation and an actuation member, connected to the shiftable chamber wall, for insertion into the plunger accommodation, and at least one seat on the opposing side. The displacement device can be inserted into the accommodation and the plunger accommodation instead of a syringe. The seat can be equipped with a pipette point. By shifting the accommodation body, the chamber wall is shifted and a pipette point set onto the adapter housing is filled with liquid or emptied, respectively. In this embodiment, a direct displacement pipette can also be used as an air cushion pipette after mounting the adapter housing. According to this embodiment, the handheld pipetting apparatus or direct displacement pipette forms a handheld pipetting system with the adapter housing. In a first way of the usage of the handheld pipetting system, the handheld pipetting apparatus can be coupled to a syringe, and in a second way of the usage, it is coupled to the adapter housing, which in turn can be coupled to at least one pipette point.

A handheld pipetting system of a handheld pipetting apparatus and an adapter housing permits dispensing, i.e. discharging a taken up amount of liquid in plural single steps, as well as pipetting, i.e. discharging a taken up amount of liquid in one single step, with a syringe as well as with a pipette point.

According to one embodiment, the adapter housing is essentially cylindrical and has the fastening portion and the actuation member at the one front side, and the seat at the other front side. This is in favour of a compact design, so that the handling properties of the handheld pipetting apparatus change only minimally when it is equipped with the adapter housing.

According to one embodiment, in which the handheld pipette is manually driven, the adapter housing has at least one spring device, against which the actuation member and/or the plunger accommodation pushes in a final phase of the movement for displacing a fluid out of the displacement chamber. The point of the contact of the actuation element and/or the plunger accommodation with the spring device defines the starting point of an aspiration stroke, in which a defined volume of liquid (the metering amount) is sucked into a pipette point. The discharge of the liquid takes place in the reverse direction, at first until the actuation member or the plunger accommodation, respectively, hits against the spring device or contacts the same anew, respectively. Further shifting of the actuation member and/or the plunger accommodation is possible by overcoming the spring force of the spring device. By this force threshold, the user perceives that the metering amount has been essentially discharged. The further actuation permits to blow out smaller residual amounts of the liquid, which adhere in or on the pipette point, respectively. By the blowout stroke, a practically complete discharge of the liquid is granted. Further, the actuation of an ejection device can be controlled by an additional ejection stroke, which separates the pipette point from the seat on the adapter housing. For this purpose, the actuation element of the adapter housing can be provided with carriers, which co-operate with an ejector sleeve which is guided on the adapter housing at the outside, by taking the ejector sleeve along with them at the end of the shifting of the actuation element. The ejector sleeve can push on the upper edge of the pipette point with its lower end, in order to push the same off from the seat.

According to one embodiment, in a first part of the final phase of the movement for displacing a fluid out of the displacer chamber, the actuation member and/or the plunger accommodation pushes against the spring device, and against a further spring device in a second part of the final phase of the movement. Through this, different force thresholds can be realised, by the overcoming of which the user can perceive whether he/she performs the blowout stroke for blowing out residual liquid, or the ejection stroke for ejecting the pipette point.

According to one embodiment, the spring device has at least one helical spring in a cage with a hole in an upper capping for the insertion the plunger accommodation, and a disc, arranged between the upper capping and the helical spring, which projects radially at the inside with respect to the hole, for pressing against the plunger accommodation.

The plunger accommodation can be shifted towards the disc through the hole. By further shifting of the plunger accommodation, the helical spring is compressed. As the case may be, an additional spring device with a further helical spring can be arranged in the cage. The further spring is shorter than the first mentioned helical spring, and it has an inner diameter which exceeds the outer diameter of the first mentioned helical spring, so that it can be arranged around the same. Further, the upper end of the additional helical spring can be supported on a further disc below a shoulder in the cage. This further disc projects radially towards the inside, so that a region protruding radially towards the outside of the first mentioned disc hits the additional disc after some compression of the first mentioned helical spring, in order that the same is also compressed when the plunger accommodation is shifted.

According to another embodiment, a syringe module, with a syringe module housing comprising the accommodation, the plunger accommodation and the fastening means, is detachably connectable with the pipette housing comprising the drive device, wherein the accommodation body having the plunger accommodation can be coupled to the drive device. Further, a pipette point module, comprising the displacement device and the seat and having a pipette point module housing, is detachably connectable with the pipette housing, wherein the chamber wall of the displacement device can be coupled to the drive device. According to usage, the user connects the syringe module or the pipette point module with the pipette housing. In this, the pipette housing can feature the drive device of a conventional dispenser or of a conventional pipette. In the drive device of a conventional manual pipette, the movement of the chamber wall for aspirating liquid into a pipette point or syringe is driven by a lifting spring, which is pre-stressed when liquid is discharged from the pipette point or syringe. In the aspiration stroke, the lifting spring pushes back the drive device into its starting position. The lifting spring may be arranged in the pipette housing as well as in the syringe module housing or in the pipette point housing, respectively.

Now follow embodiments in which all assembly parts of the handheld pipetting apparatus can be arranged in or on the pipette housing permanently.

According to one embodiment, the handheld pipetting apparatus has the accommodation and the seat at different positions of the pipette housing. In this, the plunger accommodation is associated to the accommodation, and the fastening means are associated to the accommodation and to the plunger accommodation. For instance, the accommodation and the seat are located on different ends of the pipette housing or side by side on the same end of the pipette housing. The user equips the handheld pipetting apparatus either with a syringe or with a point, according to the intended usage. In this, the accommodation body and the chamber wall of the displacement device can be driven by the same or by different drive devices. In case that accommodation body and chamber wall can be driven by means of the same drive device, they may be permanently coupled with the same, so that accommodation body and chamber wall are always shiftable simultaneously. Also, embodiments are possible in which for reducing the force expenditure in the metering, the accommodation body and the chamber wall can be selectively coupled with the same drive device, according to whether a syringe or a pipette point is to be used.

According to another embodiment, seat and accommodation body are arranged concentrically with respect to each other. For instance, the accommodation body is a sleeve-shaped body surrounding the accommodation body at the outside. When the handheld pipetting apparatus is intended to be operated as an air cushion pipette, the seat is pushed further towards the outside with respect to the pipette housing than the accommodation body. When the handheld pipetting apparatus is intended to be operated as a direct displacement pipette, the accommodation body is pushed further towards the outside with respect to the pipette housing than the seat. For this purpose, either the accommodation body is shiftable with respect to the seat which is fixed on the pipette housing, or the seat is shiftable with respect to the pipette housing, for example. When the seat is shiftable, the channel is realised to be flexible, by a flexible tube or by telescopic pipes, for instance. For usage as a direct displacement pipette, the accommodation body can be coupled with the drive device. The chamber wall can be permanently coupled to the drive device. In order to reduce the force expenditure for metering in the application as a direct displacement pipette, the chamber wall may be uncouplable from the drive device. When used as an air cushion pipette, the accommodation body is uncoupled from the drive device, and as the case may be, the chamber wall is coupled with the drive device. It is also possible to provide different drive devices for the accommodation body and the chamber wall and to actuate the drive device associated to the respective disposable part, so that coupling in and out does no more apply.

For instance, the shiftable chamber wall is a flexible membrane, which forms one wall of the displacement chamber and is sealingly connected to at least one further wall of the displacement chamber at its edge side. According to a preferred embodiment, the displacement device has a cylinder and a plunger arranged longitudinally shiftable therein and having an actuation member. This embodiment can be integrated into a cylindrical adapter housing, saving space by doing so. Furthermore, it can be driven advantageously by a linear drive device, which drives the plunger of the displacement device as well as the syringe plunger of the syringe.

According to one embodiment, the plunger has an outside situated seal in the cylinder. As a consequence, the plunger bears the seal on its outside, which seals in the interior of the cylinder. The seal on the outside runs particularly easily. Through this, the force expenditure for the actuation of the displacement device can be reduced very much. By doing so, user-friendly, manually operable handheld pipetting apparatuses are made possible, or motor-driven handheld pipetting apparatuses with small energy consumption.

According to one embodiment, the drive device has a manual and/or an electric drive device (with electric motor, for instance). In particular, the handheld pipetting apparatus can be executed as a solely manually driven device or as a solely electrically driven device or as a device with a combined manual and electric drive device, the latter case in particular when there is a manual, servo-assisted drive.

According to a further embodiment, the handheld pipetting apparatus is a fixed volume pipette or a pipette with adjustable volume.

According to a further embodiment, the handheld pipetting apparatus is a single channel or a multi channel apparatus, i.e. it can be equipped with only one single pipette point or syringe, or with plural pipette points or syringes at the same time.

According to a further embodiment, a reading device for reading a tag on a syringe or on an adapter housing and/or on a pipette point is associated to the accommodation and/or to the seat, and/or the handheld pipetting apparatus has an input device for putting in a tag of a syringe and/or of an adapter housing and/or of a pipette point, and the reading device and/or the input device is connected to an electronic analysing unit arranged in the pipette housing, which is connected to an electronic display device, which indicates operation conditions and/or settings of the pipetting device (metering parameters, for instance) depending of the tag which is read by the reading device and/or input by means of the input device, and/or which is connected to an electronic control device of the electric drive device, in order to control the same depending on the tag read by the reading device and/or input by means of the input device.

For instance, this embodiment permits to use syringes and/or adapter housings and/or pipette points which are equipped with a tag which includes properties of the syringes or pipette points, for instance the rated volume and/or the model (shape or dimensions, for instance) and/or the material and/or the purity grade and/or the manufacturer and/or the date of manufacture and/or performed use of the syringes and/or adapter housings and/or pipette points. For instance, the tag is a microchip and/or a RFID, into which data are written and/or are writable, which can be read out by the reading device.

Preferably, the tag is implemented by at least one elevation or indentation on the upper edge of the syringe and/or on the adapter housing and/or on the upper edge of the pipette point. Preferably, the tag exists on an annular flange on the upper edge. A specific encoding is given by the existence of at least one elevation or indentation or by the specific arrangement of the elevations or indentations, respectively. The reading device has pressure-sensitive sensors (piezo sensors, for instance) at the bottom of the accommodation or on the basis of the seat, respectively, which scan the elevations or indentations, respectively. As a consequence, the analysing unit can determine that one or which syringe or adapter housing or pipette point is inserted, respectively. Accordingly, the analysing unit or control unit can detect the properties of the respective inserted syringe or adapter housing or pipette point, in particular when the same is put onto the seat of the adapter housing. For instance, this permits to indicate the metering volume which is set instantly by means of an indication device, or to control an electric drive device such that always the desired metering volume is taken up or discharged, respectively. In particular, different speeds, accelerations and delays of the plunger of the syringe or of a displacement device can be controlled according to syringe or pipette point.

The reading device and the tag can be formed like the scanning surfaces and scanning devices according to EP 0 657 216 B1, the entire contents of which is incorporated herein by reference, the disclosures of which relevant to this are incorporated into the present application by reference.

According to one embodiment, the reading device associated to the seat can be coupled with the reading device associated with the accommodation via a transfer device in the adapter housing. In this, the information concerning the tag retrieved by the reading device associated to the seat is transferred to the reading device associated to the accommodation.

According to one embodiment, the reading device associated to the seat and the transfer device in the adapter housing have slides, arranged to be longitudinally shiftable for scanning elevations and/or indentations on the upper edge of the pipette points, with ends of the sliders associated to the seat and further ends of the slides for actuating pressure-sensitive sensors. In particular, the slides can be realised as wires, which can run along curved guidings in the adapter housing. Through this is permitted the scanning of elevations or indentations, respectively, on an upper edge of a pipette point with relatively small diameter and the transfer of the scanning to a reading device for acquiring elevations or indentations, respectively, on the edge of a syringe of relatively great diameter.

The input device may be existing instead of at least one reading device or in addition to the same. It permits manual input of a tag. In the simplest case, the input device is a switch which permits a change-over between at least two different syringes or pipette points, or from syringes to pipette points. It may also be realised as a keyboard or as a touchscreen.

With syringes, the liquid column moved by the plunger clings directly to the plunger, so that the metered volume of the liquid depends linearly from the shifting of the plunger by means of the drive device. On the contrary, in pipette points a volume error arises due to the expansion of the gas cushion between the plunger or another shiftable chamber wall of the displacement device and the liquid column. In particular, the volume error depends on the inner geometry of the pipette point, the density of the metered liquid, the respective height of the liquid column in the pipette point and from the geographical altitude of the workplace. The height of the liquid column depends on the metering amount.

In an electronically controlled pipette with electric drive, a correction is possible by additionally shifting the plunger about a certain correction volume at every certain metering amount. In a manually driven handheld pipetting apparatus with a linear drive gear between an actuation button or a plunger or a shiftable chamber wall, respectively, minimising the metering error across the entire adjustment range of dosable liquids is possible by the selection of the gear ratio of the drive gear and/or of the indicating device for the metering volume. For details of this error minimizing, it is made reference to EP 0 562 358 B2 in particular, the entire contents of which is incorporated herein by reference, to the claims and examples of page 3, line 53 to page 6, line 49 in particular. The content of EP 0 562 358 B2, the entire contents of which is incorporated herein by reference, is incorporated into the present application by reference.

The following embodiments serve for minimising or reducing, respectively, the metering error when selectively working with syringes and pipette points.

According to a simple embodiment of a manually driven handheld pipetting apparatus, there is a switch which permits to change over the indication of the metering volumes with syringes to the indication of metering volumes with pipette points. For instance, the switch may be a switch of a mechanical gear, by the actuation of which different gear ratios of a mechanical gear for controlling a mechanical display (a mechanical counter, for instance) can be set. Further, it may be an electric switch for changing over the operation of the analysing unit or of the control unit, respectively.

According to another embodiment of a handheld pipetting apparatus, the electronic analysing device controls a correction of the indication of the metering volume, depending on the read out and/or input tag of a pipette point. In case that the tag is read out automatically, the changeover may take place automatically. In case that the tag of a syringe is input or read, a correction may be omitted in principle. When necessary, a correction may also take place with a syringe, however.

According to one embodiment of a handheld pipetting apparatus which is driven electrically, the control device controls a correction of the stroke of the shiftable chamber wall by means of the electric drive device, depending on the read out and/or input tag of a pipette point. When the tag is read in automatically, the correction may take place automatically. In case that the tag of a syringe is input or read, a correction can be omitted in principle. When necessary, a correction may also take place with a syringe, however.

According to one embodiment of a handheld pipetting apparatus which is driven electrically, the control device controls by means of the electric analysing device an initial positioning of the shiftable chamber wall into a position which is remote about a residual stroke from the end position for complete fluid discharge, depending on a read out and/or input tag of a pipette point. In this way, a blowout stroke and/or an ejection stroke is made possible for an electrically driven handheld pipetting apparatus. When a tag of a pipette point is read or input, the control device moves the plunger into a position which permits a residual stroke which can be used for blowing out residual liquid from the pipette point and/or for ejecting the pipette point.

According to a further embodiment, the handheld pipetting apparatus has a drive device featuring an electric drive and an electronic control device connected thereto for operating the metering apparatus in a titration mode.

The titrimetric analysis or titrimetry is a determination method of the chemical analytics, in which the dissolved substance to be determined (the titrant or solution to be titrated) is reacted with an other substance of known concentration (the titrans, titration liquid, standardized solution), also mostly in a dissolved state, up to an end point, equivalency point or apex point (called hereinafter "end point" in a summarizing manner). The determination procedure is called titration. The end point is indicated by an indicator system, for instance, or in an electrochemical way or by means of a precipitation reaction. The accurate perception of the end point can be promoted by the metering apparatus which is used. In particular, optimisation is possible by selective use of syringes and pipette points. The handheld pipetting apparatus of the present invention promotes the optimal use of syringes and pipette points and through this the accurate determination of the end point.

In the titration mode, the control device can reduce the speed of syringe plunger or the chamber wall, respectively, automatically about one level in each delivery step, in order to reach the end point as accurately as possible. Finally, the speed can remain constant at the lowest level.

Further, one embodiment of the titration mode is possible in which the handheld pipetting apparatus acquires a tag of the syringe and/or of the adapter housing and/or of the pipette point by means of a reading device, and the control device controls the movement of the syringe plunger and/or of the chamber wall, depending on the acquired tag and optionally of the actuation of an operating device. In this, the handheld pipetting apparatus can be realised like the metering apparatus according to any one of the claims 1 to 9 and 22 to 30 of the German patent application DE 10 2006 009 816.1, the entire contents of which is incorporated herein by reference, the disclosure of which is incorporated into the present application by reference.

According to another embodiment, the control device can control a movement of the syringe plunger and/or of the chamber wall for the discharge of great amounts of liquid in a first delivery phase in the titration mode, and triggered by an actuation of the input device or by reaching the end of the first delivery phase, it can control a movement of the plunger for the discharge at least a small, defined amount of liquid in a second delivery phase. In this, the handheld pipetting apparatus can be realised like any one of the claims 10 to 30 of the German patent application DE 10 2006 009 816.1, the entire contents of which is incorporated herein by reference, the disclosure of which is incorporated into the present application by reference.

According to a further embodiment, the handheld pipetting apparatus has an input device (keyboard or touchscreen, for instance) which is connected to the electronic control device, for selecting an operating mode from a group of operating modes comprising a titration mode.

According to a further embodiment, the group of operating modes comprises a pipetting mode and/or a dispensing mode and/or a sequential dispensing mode and/or an aspiration mode.

According to one embodiment, the handheld pipetting apparatus has the following features: a drive device having an electric drive, a program controlled electronic control- and/or regulation device for the drive, at least one non-volatile write-read memory, an electric power supply, for the electric drive and the electronic control- and/or regulation device in particular, a data interface, connected to the electronic control- and/or regulation device, for connection with a data transfer device of an external data processing device, wherein the program controlled electronic control- and/or regulation device is designed such that by means of the data processing unit, routines for performing operating processes of the handheld pipetting apparatus, on which the program controlled electronic control- and/or regulation device reverts, can be written into the write-read memory via the data interfaces.

According to the present invention, the read-write memory of the handheld pipetting apparatus can be accessed by means of the external data processing device. This provides the possibility to place routines for performing operating processes into the write-read memory of the handheld pipetting apparatus by means of the external data processing devices, so that the program controlled electronic control- and/or regulation device reverts to the same. These routines can be created by the user and they serve for controlling operating processes which are composed of plural operating steps, in particular when the same have to be performed repeatedly. For instance, the pick-up, the mixing and the delivery of certain amounts of liquid can be controlled by means of such a "short program", or a dilution series, in which the discharged metering volume is cut into halves from one dilution step to the next dilution step. Through this, the use of routines is facilitated for the user. Also, there is the possibility to copy routines stored in the data processing unit into the handheld pipetting apparatus.

Furthermore, the program of the program controlled electronic control- and/or regulation device can be written into the read-write memory by means of the external data processing device, and optionally it can be read out from the same. For this purpose, the memory is preferably a flash memory of a processor. A processor with a flash memory has implemented a program charged by the manufacturer, which can initiate the communication for a data exchange via an interface. Through this, it is possible to transfer a partially or completely different program into each handheld pipetting apparatus via the data interfaces from the outside, or to change the program completely or partially, respectively.

In addition, it is possible to change operating parameters to which the program controlled electronic control- and/or regulation device reverts when it performs operating steps.

Furthermore, remote control of the handheld metering apparatus is possible by means of the external data processing device.

The data transfer from the handheld pipetting apparatus to the data processing unit, which may be a PC in particular, and reciprocally, can take place via an infrared interface. The handheld pipetting apparatus can be recognised and registered automatically by the PC, when it is arranged in a certain distance range from the infrared interface. Then, certain work cycles of the handheld pipetting apparatus can be controlled by means of the PC (for instance, permanent operation, pipetting, dispensing, individual steps of the electric drive motor and so on). This can be used for servicing purposes and/or for the remote control of the handheld pipetting apparatus. Further, routines and/or parameters can be written into the read-write memory of the handheld pipetting apparatus and/or read out from the same by means of the PC.

The data transfer may also take place via radio, for instance with a frequency in the range of 2.40 to 2.48 Ghz, which is permitted worldwide for corresponding applications. The data transfer may use the protocols Bluetooth, Wlan or Zigbee in particular.

In addition, possible embodiments of a corresponding metering system of handheld pipetting apparatus and external data processing device are found in EP 0 999 432 B1 the entire contents of which is incorporated herein by reference. The explanations concerning this are incorporated into the present application by reference to this document.

Finally, the present invention is related to an adapter housing with features of the adapter housing for use in a handheld pipetting.

BRIEF DESCRIPTION OF THE SEVERAL VIEWS OF THE INVENTION

Figure 2:
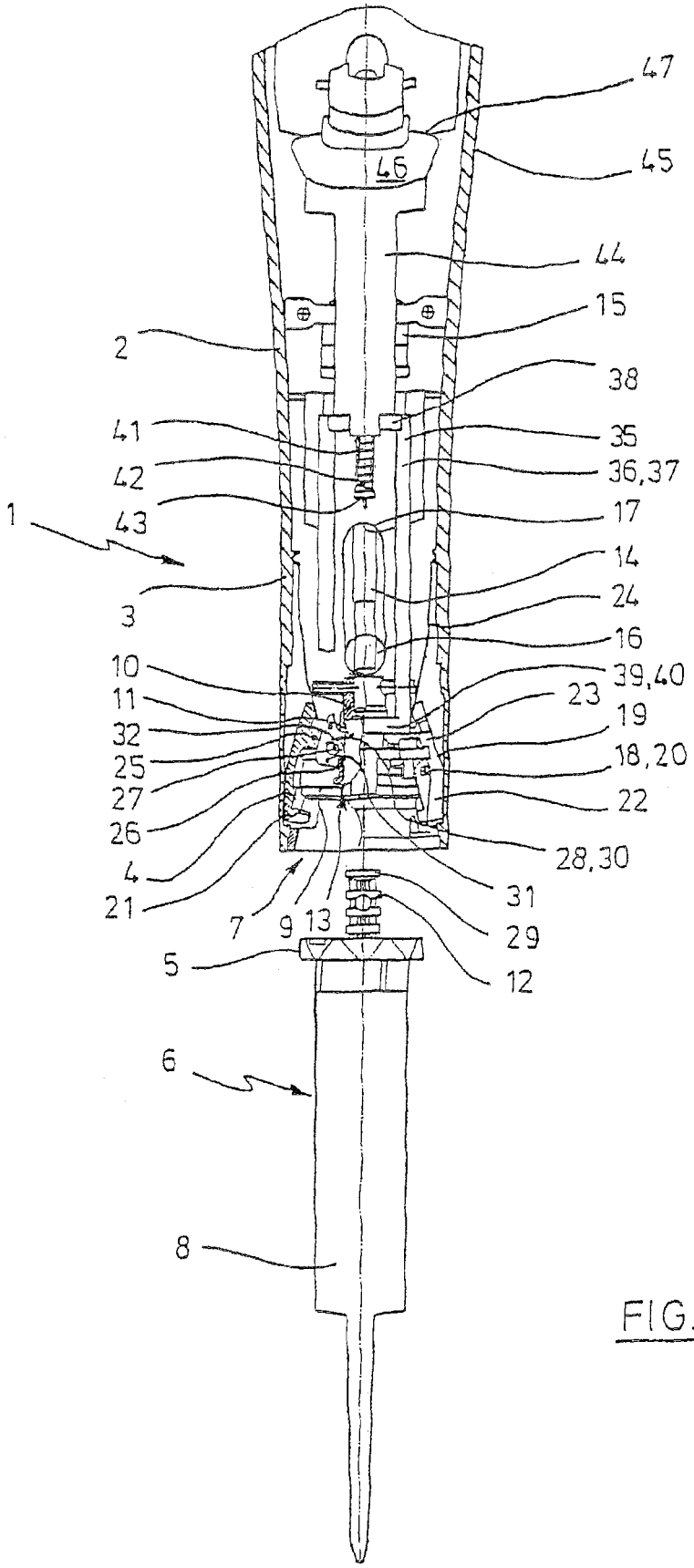
Figure 3:
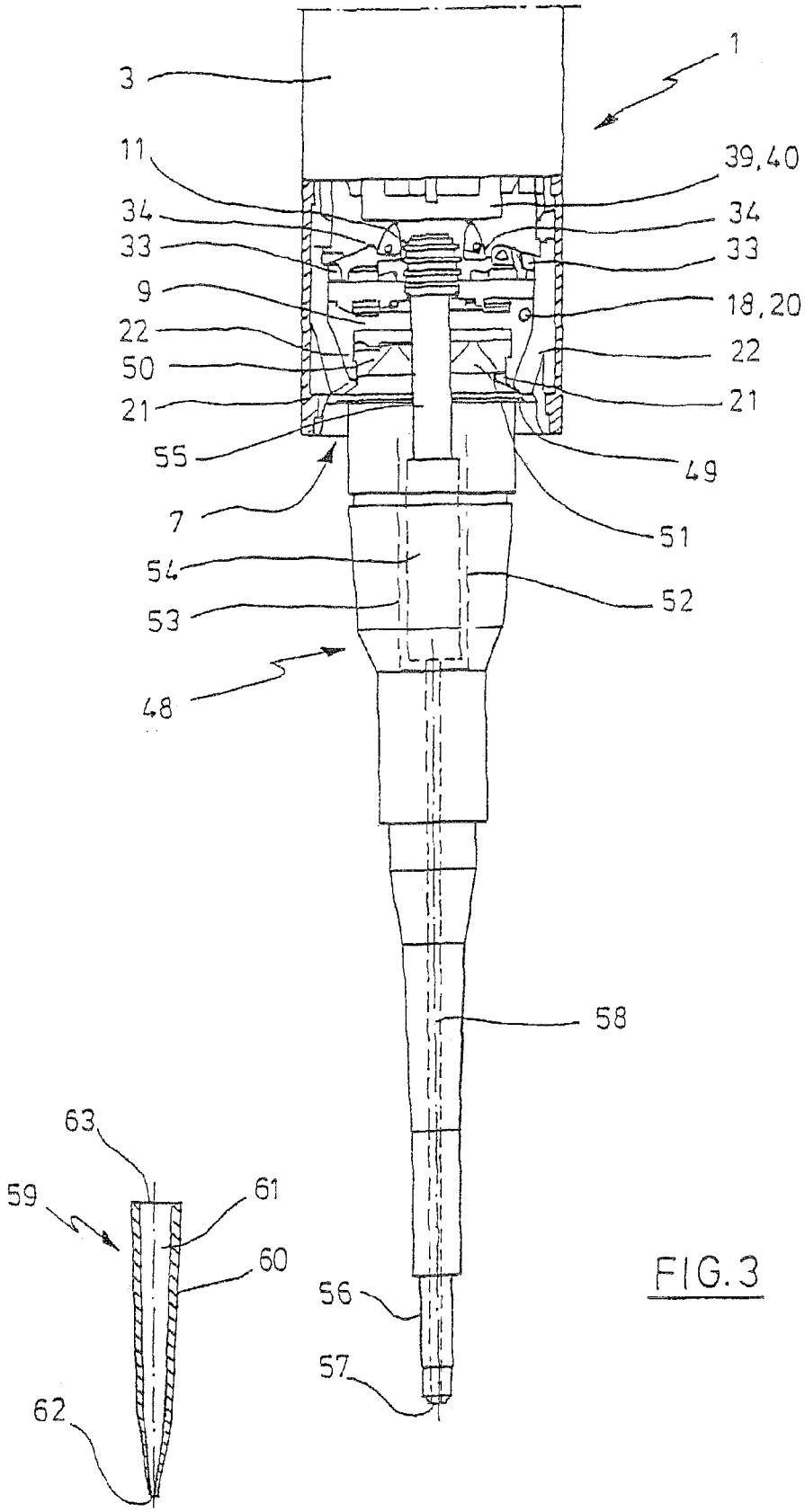
Figure 4:
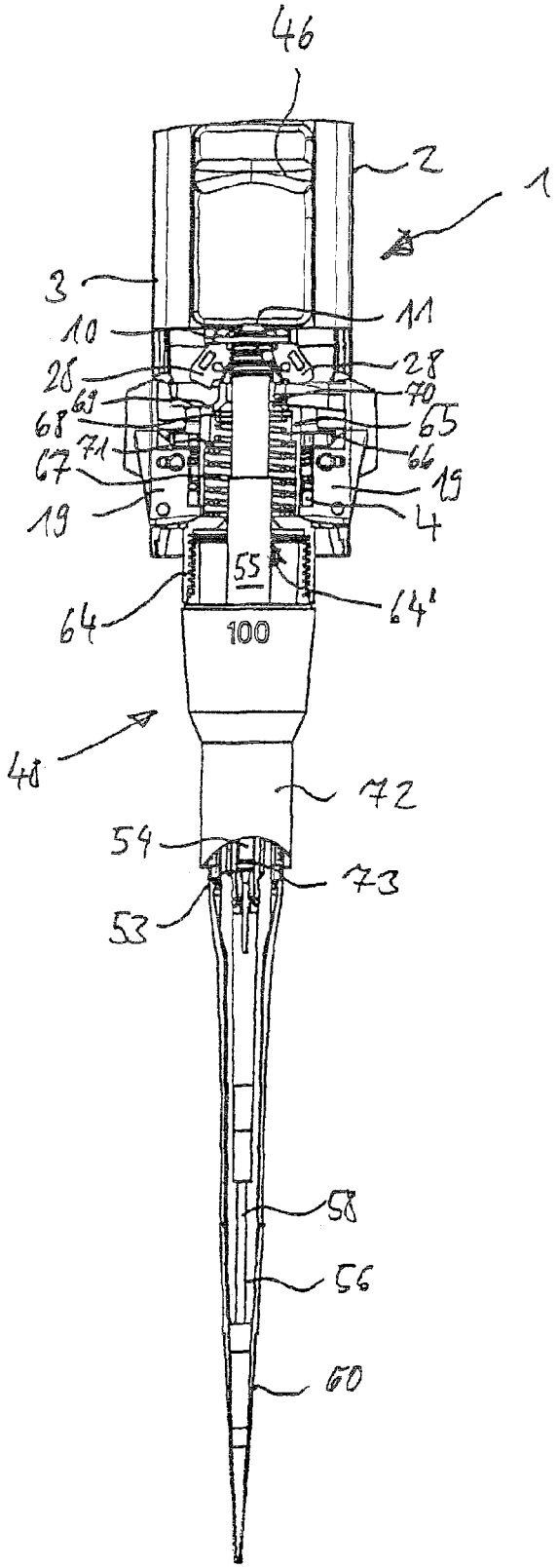
Figure 5:
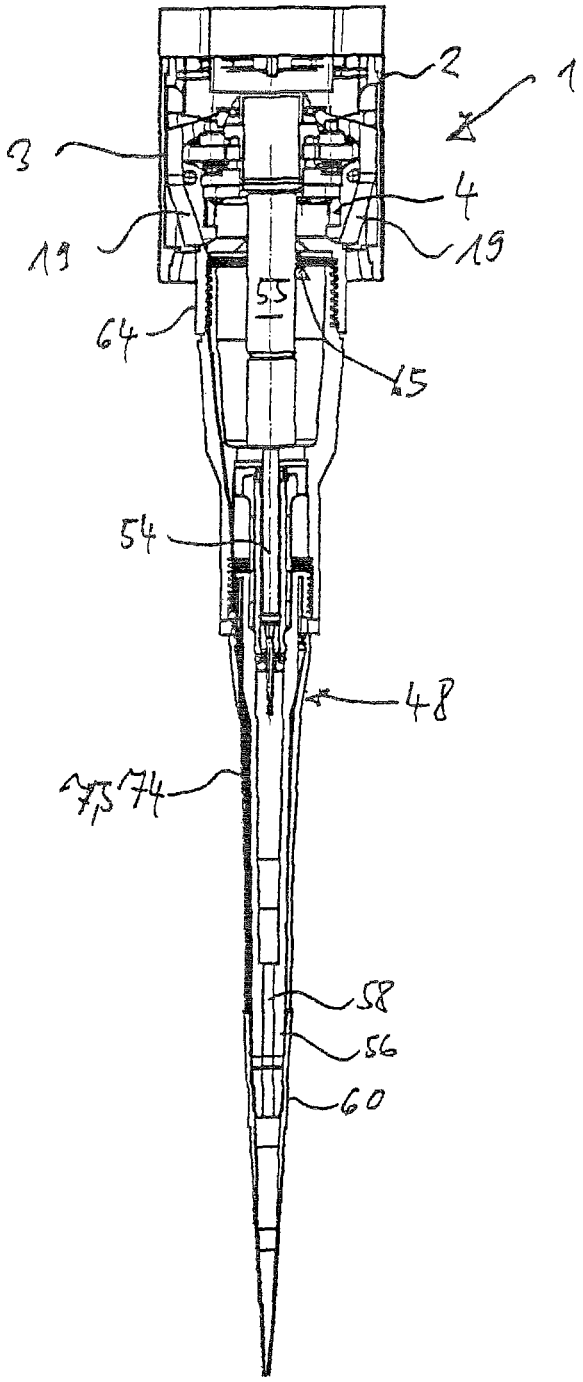
Figure 6:
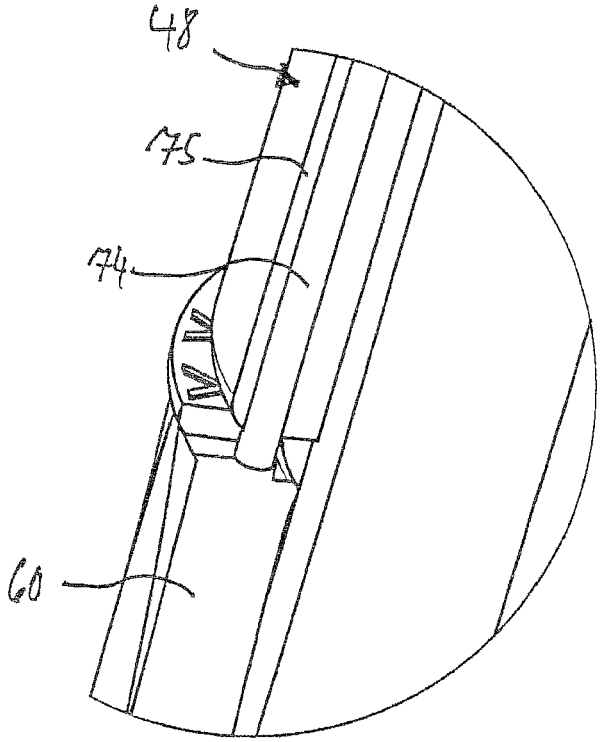
Figure 7:
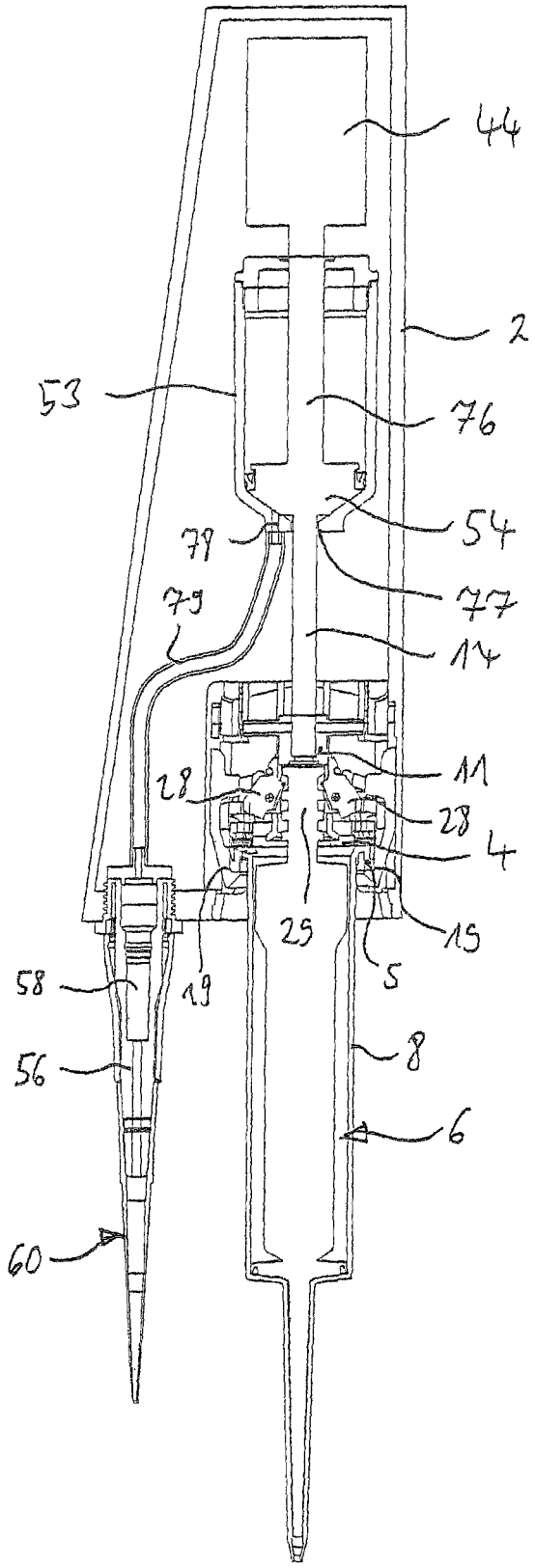

The invention will be hereinafter explained in more detail by means of the attached drawings of an example of its realisation. In the drawing show:

FIG. 1 a handheld pipetting apparatus with a syringe held therein in a longitudinal section (left half) and with housing half taken off (right half);

FIG. 2 the same handheld pipetting apparatus with actuated fastening means and separated syringe, in a longitudinal section (left half) and with housing half taken off (right half);

FIG. 3 the same handheld pipetting apparatus with adapter housing held therein, in an enlarged partial section through the lower region of the handheld pipetting apparatus and the adapter housing;

FIG. 4 a handheld pipetting apparatus with adapter housing held therein, in an enlarged partial section;

FIG. 5 a handheld pipetting apparatus with an adapter housing having a scanning equipment for pipette points, in a longitudinal section;

FIG. 6 the scanning equipment of the handheld pipetting apparatus of FIG. 5, in an enlarged partial section;

FIG. 7 a handheld pipetting apparatus with seat and accommodation on the pipette housing, in a rough schematic longitudinal section.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated The indications "at the bottom", "below" and "on top", "above" are related to the orientation of the pipette when it is used with syringe or pipette point held towards the bottom side, respectively.

In the subsequent explanation of different examples of the realisation of the present invention, constructional elements corresponding to each other are denoted with the same reference numerals.

According to FIGS. 1 and 2, the handheld pipetting apparatus has a handleable, grip-like shaped pipette housing 2 with an essentially cylindrical housing bottom part 3. In the lower end region of the housing bottom part 3 is arranged an accommodation 4 for a syringe flange 5 of a syringe 6. The syringe flange 5 is a fastening portion of the syringe 6. On the lower end of the housing bottom part 3, the accommodation 4 has an axial opening 7, through which the syringe 6 held in the accommodation 4 protrudes with its syringe cylinder 8.

In the accommodation 4 is arranged a spring-tensioned abutment 9, against which the upper side of the syringe flange 5 can be pressed. On the upper side of the syringe flange 5, the abutment 9 has not shown sensors for scanning an encoding in the form of not shown elevations or indentations, respectively.

An accommodation body 10 is arranged in the housing bottom part 3, with a plunger accommodation 11 into which an end portion of a syringe plunger 12 of the syringe 6, projecting towards the topside, can be inserted. In this, the syringe plunger 12 projects into the accommodation body 10 through an axial opening 13 of the plunger accommodation 11. The upper end of the syringe plunger 12 hits a plunger stop, which is formed by a bottom of the plunger accommodation 11.

The accommodation body 10 is fixed on a lifting rod 14, which is connected to a plunger adjustment device 15. For instance, the plunger adjustment device 15 is a manually or electromotorically driven linear drive or a plunger adjustment device 15 with repetition mechanism, as is known from DE 29 26 691 C2 or DE 43 41 229 C2. Regarding the explanations of the repetition mechanism, it is made reference to the two documents mentioned above.

The lifting rod 14 is connected with a backward movement lever 16, which protrudes towards the outside from an axial slit 17 of the housing bottom part 3. Thus, the accommodation body 10 can be shifted axially in the housing bottom part 3 by actuating the backward movement lever 16.

In order to fix the syringe flange 5 in the accommodation 4, syringe gripping levers 19 are bearing mounted in diametrically opposing bearings 18 on both sides of the accommodation 4 on swivel pins 20 in the housing bottom part 3. The syringe gripping levers 19 are enclosed by the housing 2. The syringe gripping levers 19 are provided with hook-shaped gripping ends 21, by which they can grasp behind the bottom side of the syringe flange 5, when the same is set into the accommodation 4 and sits close to the abutment 9.

The syringe gripping levers 19 are arranged below the swivel pins 20 with a gripping arm 22. An actuation arm 23 of the syringe gripping levers 19 is situated above the swivel pins 20.

On the inner shell of the housing bottom part 3, two leaf springs 24 are arranged, which are fixed on the housing bottom part 3 with their upper ends. The lower end of the leaf springs 24 presses against the inner sides of the syringe gripping levers 19.

As a consequence, the syringe gripping levers 19 are prestressed in the direction of the position where they grasp behind the syringe flange 5.

On the inner sides of its actuations arms 23, the syringe gripping levers 19 have each at a time an unlocking cam 25, which is directed towards the accommodation body 10.

The accommodation body 10 is provided with breaking-troughs 26 on sides diametrically opposing each other. On these breaking-troughs 26, plunger gripping levers 28 are mounted on swivel pins 27 on the accommodation body 10. The plunger gripping levers 28 can grasp behind a plunger fastening portion on the outermost end of the syringe plunger 12, which is formed as plunger collar 29. For this purpose, they have an approximately wedge-shaped gripping end 30, which is arranged above the swivel pins 27. Below the swivel pins 27, there is an actuation end 31. Altogether, the plunger gripping levers 28 have a contour resembling a lozenge.

The gripping levers 19, 28 each have lever arms of about equal length. However, the plunger gripping levers 28 are shorter than the syringe gripping levers 19.

On the swivel pins 27 of the plunger gripping levers 28, branch springs 32 are arranged, which pretension the plunger gripping levers 28 into the direction of a position in which they grasp behind the plunger collar 29. The outer side of the actuation end 31 of the plunger gripping levers 28 is shaped such that in this locking position, it is situated in the swivel region of the unlocking cams 25 on the inner side of the syringe gripping levers 19. The correct orientation of the plunger gripping levers 28 towards the syringe gripping levers 19 is ensured by the guiding of the backward moving lever 16 in the axial slit 17.

Releasing levers 33 project towards the inside from the inner side of the actuation arms 23 of the syringe gripping levers 19. The releasing levers 33 are connected to the upper ends of the actuation arms 23 and are inclined in acute angels with respect to the axis of the syringe plunger 12.

The releasing levers 33 are rounded 34 at their ends.

A transfer element 35 is arranged in the pipette housing 2. The transfer element 35 has plural rods 36, arranged parallel to the axis of the syringe plunger 12, which are guided in guidings 37 in the pipette housing 2. The rods 36 are connected at the ends by bridge elements 38, 39. The bride element 39 has a rest surface 40 at the bottom. By shifting the transfer element 35 in the guidings 37, it is possible to make the rest surface 40 sit close to the rounded ends 34 of the releasing levers 33.

The bridge element 38 has a tenon 41, which is directed parallel to the axis of the plunger 12. A helical spring 42 is guided on the tenon 41, which rests on the bottom side of the bridge element 38 and is supported at the other end on an abutment 43, which is fixed on the housing.

At the topside, the transfer element 35 is connected to an actuation rod 44, which is guided along the inner side of the pipette housing 2. The actuation rod 33 is connected to a laterally projecting release button 46 in the upper casing part 45 at the topside. Through a recess 47, the release button 46 projects laterally towards the outside from the pipette housing 2. The release button 46 is arranged near to the upper end of the pipette housing 2, and by this near to further, not shown operating elements, for example for the plunger adjustment device 15 and for the metering amount, for instance.

According to FIG. 3, an adapter housing 48 which is cylindrical at the topside is arranged in the handheld pipetting apparatus 1. At its topside, the adapter housing 48 has a circumferential groove 49 at the outside. Above it there is an adapter flange 50, whose dimensions are corresponding to those of the syringe flange 5. The adapter flange 50 is also provided with an encoding in the form of elevations and indentations at its upper side, which is not shown in detail and which can be scanned by means of the sensors in the abutment 9. Co-operating with at least one guiding nose in the accommodation 4, the triangular projections 51 which are present on the outer perimeter of the adapter flange 50 serve for directing the adapter housing 48 into a correct rotational position, so that the elevations and indentations are correctly directed towards the sensors. The syringe flange 5 is provided with corresponding triangular projections on its outer perimeter.

In the adapter housing, there is a displacement device 52, which comprises a cylinder 53 and a plunger 54, arranged longitudinally shiftable therein. At the topside, the plunger 54 is provided with an actuation member 55 in the form of a plunger rod, which can be inserted into the plunger accommodation 11 with its upper end region.

The adapter housing 48 tapers towards the bottom in a sequence of cylindrical or conical, respectively, adapter housing portions. At the lower end, it has a seat 56 in the form of a plug-up cone. The same has a hole 57 in the first end surface. The hole 58 is connected with a hole in the bottom of the cylinder 52 via a channel 58.

The adapter housing 48 is set into the accommodation 4, such that the topside of the adapter flange 50 presses against the spring-tensioned abutment 9. The syringe gripping levers 19 keep hold of the adapter flange 50 with their hook-shaped gripping ends 21. The upper region of the actuation member 55 is held in the plunger accommodation 11 by the plunger gripping levers 28.

A pipette point 59 has a pipe-shaped point body 60 with plural conical portions having a passage channel 61 extending in the axial direction across the whole length, which has a point opening 62 at the lower end of the point body 60 and an air passage opening 63 at the upper end of the point body 60. The pipette point 59 can be clamped up on the seat 56 with the air passage opening 63.

The handheld pipetting apparatus 1 is used in the following way:

Proceeding from FIGS. 1 and 2, the operation as direct displacement pipette is described at first.

By means of the backward moving lever 16, the adapter housing body 10 is moved towards the accommodation 4 as far as possible. A syringe 6 is inserted into the accommodation 4 through the axial opening 7, advancing with the upper end of the syringe plunger 12 and the flange 5. By doing so, the upper end of the syringe plunger 12 sinks into the plunger accommodation 11 of the accommodation body 10, and the syringe flange 5 is pressed against the spring tensioned abutment 9. In this, the syringe gripping levers 19 and the plunger gripping levers 28 are pressed towards the outside against the spring action, and then, due to the spring action, they snap behind the syringe flange 5 with their gripping ends 21, and behind the plunger collar 29 with the gripping ends 30. Thereafter, the syringe 6 is fixed in the accommodation (compare FIG. 1).

By moving the backward moving lever 16 towards the upside, liquid can be sucked up into the syringe 6. A metering amount is set via suitable adjustment devices. By actuating the plunger adjustment devices 15, the syringe plunger 12 is moved downward and the desired amount of liquid is discharged.

When the syringe 6 is emptied, the plunger accommodation 10 is in the lowermost position, in which the plunger gripping levers 28 can be actuated by actuating the syringe gripping levers 19.

After the metering has taken place, the syringe 6 can be ejected by actuating the releasing button 46. For this purpose, the releasing button 46 is pushed downward by the user (compare FIG. 2). By doing so, the actuation rod 44 and the transfer element 35 connected thereto are moved downward, against the action of the helical spring 42. When the stop surfaces 40 hit the releasing levers 33, the syringe gripping levers 19 swivel towards the outside with their gripping ends 21 and deblock the syringe flange 5. The unlocking cams 25 on the inner sides of the actuation arms 23 hit against the actuation ends 31 at the outside and swivel the gripping ends 30 of the plunger gripping levers 28 towards the outside, so that the same unblock the plunger collar 29. The spring tensioned abutment 9 presses the syringe flange 5 downward and ejects the syringe 6 from the pipette.

After releasing the releasing button 46, the releasing mechanism 35, 44, 46 and the gripping levers 19, 28 revert into their starting positions, due to the action of the springs 42, 24, 32 (compare FIG. 1).

Then, the handheld pipetting apparatus 1 is ready for taking up a new syringe 6.

In case that the pipette 1 is to be operated as an air cushion pipette, the adapter housing 48 is set into the accommodation 4 instead of a syringe 6. In this, the adapter housing body 10 is moved towards the accommodation 4 as far as possible again. The adapter housing 48 is inserted through the axial opening 7 into the accommodation 4, advancing with the adapter flange 50 and the fastening portion. In this, the actuation member 55 sinks into the plunger accommodation 11. The syringe gripping levers 19 and the plunger gripping levers 28 clamp fast the adapter flange 50 and the actuation member 55.

The pipette point 59 is pressed up onto the seat 56 with its air passage opening 63, so that it is clamped fast there.

By moving the backward moving lever 16 and with it the plunger 54 towards the upside, liquid can be sucked up into the pipette point 59. The metering amount can be set via suitable adjustment devices. By actuating the plunger adjustment devices 15, the plunger 54 is moved downward and the desired amount of liquid is discharged from the pipette point 59.

Thereafter, the pipette point 59 can be pulled off and be replaced by a new pipette point 59.

In case that the handheld pipetting apparatus 1 is to be used as a direct displacement pipette, the adapter housing 48 is separated from the pipette housing. This takes place like the separation of a syringe 6 in the manner described above.

The realisation example of FIG. 4 differs from that one described above in particular in that the adapter housing 48 is closed towards the upside by a screwed-up cap 64, which has a passage hole 64' across which the actuation member 55 is guided through.

The cap 64 carries a cylindrical cage 65, in which a longer helical spring 66 of smaller diameter and a shorter helical spring 67 of greater diameter are arranged. Via a disc 68, the longer helical spring 66 is supported on a capping 69 of the cage 65, which has a hole 70.

The shorter helical spring 67 is supported on an inner shoulder of the cage 65 by a further disc 71.

The outer diameter of the first disc 68 is greater than the inner diameter of the further disc 71, which in turn exceeds the outer diameter of the longer helical spring 66.

The helical springs 66, 67 are preferably kept under prestress between the cage 65 and the cap 64.

The accommodation body 10, which accommodates the actuation member 55 in the plunger accommodation 11, which is kept therein by means of the plunger gripping levers 28, can be inserted into the cage 65 through the hole 70, so that it hits the first disc 68 with its lower end. For a further movement of the plunger accommodation 11 towards the downside, the user must apply an increased force. Through this, he/she recognises that he/she performs a blowout stroke, which serves only for blowing out residual amounts of the seized liquid from the pipette point 60 which is pinned up on the seat 56.

Through this, the first disc 68 is moved downward, until it hits the further disc 71 and takes the same along with it. As a consequence, the shorter helical spring 67 is compressed also, so that the user must overcome an additional force threshold. This indicates to him/her that he/she actuates an ejector for ejecting the pipette point.

The sleeve-shaped ejector 72 is guided on the adapter housing 48 at the outside, where it can be shifted axially. With the lower edge, it sits close to the upper edge of the pipette point 60. Not shown carriers on the actuation member 55 take the ejector 72 along with them, as soon as the second force threshold has been reached.

Further, in the realisation example of FIG. 4, the plunger 54 is provided with an external seal 73, which sits close to the cylinder 53 in the interior thereof. The external seal runs with particularly low resistance and thus it can be actuated in a force saving manner.

As a peculiarity, the realisation of FIGS. 5 and 6 has plural slides 74 in the form of preferably springy wires, which are guided from the lower end to the upper end of the adapter housing 48 through curved channels 75. The wires 74 are prestressed by means of not shown spring devices, such that they are pressed to the lower end of the adapter housing 48. They sit on the upper edge of the pipette point, which is provided with elevations and indentations. As a consequence, the wires 74 which sit on the indentations are pressed further downward by the spring devices than those wires 74 which sit on the elevations.

The upper ends of the wires are associated to a not shown scanning device in the pipette housing 2. The scanning device has a collar with pressure-sensitive sensors. The wires 74 associated to the indentations in the pipette point do not press against a pressure sensitive sensor. The wires 74 sitting on the elevations actuate an associated pressure sensitive sensor. As a consequence, an encoding on the upper edge of the point is transferred to the pressure sensitive sensors of the scanning device in the pipette housing 1 by means of the wires 74.

The signals furnished by the pressure sensitive sensors are forwarded to an analysing unit, which controls an indication device for instance such that the respective metering volume of the pipette point that was taken up is accurately indicated. A volume error which is due to a displacement of the air cushion due to the weight of the pipetted liquid column can be corrected automatically in this. This volume error does not matter when the adapter housing 48 is dismounted and a syringe 6 is set into the accommodation 4. Namely, the volume metered by means of the syringe depends linearly on the dislocation of the syringe plunger.

The realisation example of FIG. 7 has a pipette housing 2, which has a seat 56 for a pipette point 60 as well as an accommodation 4 for a syringe 6 on its lower end, so that this handheld pipetting apparatus can be optionally equipped with a pipette point 60 or with a syringe 6 without alteration measures.

The pipette housing 2 of the handheld pipetting apparatus comprises a manual or electric drive device 44, which is coupled to a plunger 54 arranged in a cylinder 53 via a further lifting rod 76. This displacement device 52 with plunger 54 and cylinder 53 is also arranged in the pipette housing 2.

The cylinder 53 has a passage hole 77 in its bottom, across which a lifting rod 14 is sealingly guided through. At the downside, the lifting rod 14 carries the plunger accommodation 11, in which the plunger fastening portion 29 of the plunger of the syringe 6 can be fixed by means of fastening means 28.

Further, in the accommodation 4 there are syringe gripping levers 19 for holding a flange 5 on the upper edge of the cylinder 8 of the syringe 6.

The cylinder 53 has a further passage hole 78 in its bottom, which is connected to a channel 58 in the seat 56 for the pipette point 60 via a tube or another channel 79, respectively.

The handheld pipetting apparatus is equipped either with a pipette point 60 or with a syringe 6. By actuating the displacement device 53 by means of the drive device 44, liquid can be sucked up into the pipette point 60 or the syringe 6 or discharged of the same, respectively.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A handheld pipetting apparatus for metering liquids, with a handleable pipette housing (1), at least one accommodation (4) for a fastening portion (5) of a syringe cylinder (8) of a syringe (6), at least one plunger accommodation (11) in an accommodation body (10) for a plunger fastening portion of a syringe plunger (12) of the syringe (6), fastening means (19, 28) for detachably holding the fastening portion (6) in the accommodation (4) and the plunger fastening portion (29) in the plunger accommodation (11), at least one displacement device (52) with a displacement chamber (53) and a shiftable chamber wall (54) limiting the same, for displacing a fluid; at least one seat (56) for detachably holding a pipette point, a channel (58), connecting a hole (57) in the seat (56) with a displacement chamber (53), and at least one drive device (44), which is connected to with the accommodation body (10), for shifting the accommodation body (10) with respect to the accommodation (4), or the chamber wall (54) with respect to the displacement chamber (53), wherein at the one side, the displacement device (50) has an adapter housing (48) with a fastening portion (50) for fastening in the accommodation (4) and an actuation member (55), connected to the shiftable chamber wall (54), for insertion into the plunger accommodation (11), and at least one seat (56) for a pipette point on the opposing side wherein the drive device (44) is an electric drive device, wherein at least one reading device for reading a tag on a syringe (6) which includes properties of the syringe (6) or a tag on an adapter housing (48) which includes properties of the pipette point is associated to the accommodation (4)and the reading device is connected to an electronic analyzing unit arranged in the pipette housing (1), which is connected to an electronic control device of the electric drive device (44), in order to control the same depending on the tag read by the reading device, wherein the control device controls a correction of the stroke of the shiftable chamber wall (54) by means of the electric drive device, depending on the read or input tag of a pipette point (60), and wherein by means of the electric analyzing device, the control device controls an initial positioning of the shiftable chamber wall (54) into a position which is remote about a residual stroke from the end position for complete fluid discharge, depending on the read tag of a pipette point (60).

2. A handheld pipetting apparatus according to claim 1, wherein the adapter housing (48) is essentially cylindrical and has the fastening portion (50) and the actuation member (55) at the one front side, and the seat at the other front side.

3. A handheld pipetting apparatus according to claim 2, wherein the plunger (54) has an outside situated seal (73) in the cylinder (53).

4. A handheld pipetting apparatus according to claim 1, wherein the displacement device (52) has a cylinder (53), and a plunger (54) arranged longitudinally shiftable therein and having an actuation member (55).

5. A handheld pipetting apparatus according to claim 1, which is a fixed volume pipette or a pipette with adjustable volume.

6. A handheld pipetting apparatus according to claim 1, which is a single channel or a multi channel apparatus.

7. A handheld pipetting apparatus according to claim 1, which has an input device for putting in a tag of a syringe or of an adapter housing or of a pipette point, and the input device is connected to the electronic analysing unit, which is connected to an electronic display device, which indicates operation conditions or settings of the pipette depending of the tag which is input by means of the input device or which is connected to the electronic control device of the electric drive device (44), in order to control the same depending on the input by means of the input device.

8. A handheld pipetting apparatus according to claim 1, wherein the reading device associated to the seat can be coupled with the reading device (74) associated with the accommodation (4) via a transfer device (74) in the adapter housing (48).

9. A handheld pipetting apparatus according to claim 1, wherein the reading device associated to the seat and the transfer device in the adapter housing have slides (74) arranged to be longitudinally shiftable, for scanning elevations or indentations on the upper edge of the pipette point (60), with an end of the sliders (74) associated to the seat and further ends of the slides (74) associated to the accommodation.

10. A handheld pipetting apparatus according to claim 1, with a drive device having an electric drive and an electronic control device connected thereto, for operating the metering device in a titration mode.

11. A handheld pipetting apparatus according to claim 10, with an input device connected to the electronic control device, for selecting an operating mode from a group of operating modes comprising a titration mode.

12. A handheld pipetting apparatus according to claim 11, wherein the group of operating modes comprises a pipetting mode or a dispensing mode or a sequential dispensing mode or an aspiration mode.

13. A handheld pipetting apparatus according to claim 11, wherein the input device comprises a keyboard or a touchscreen.

14. A handheld pipetting apparatus according to claim 1, with a drive device having an electric drive, a program controlled electronic control- or regulation device for the drive, at least one non-volatile write-read memory, an electric power supply, for the electric drive and the electronic control- or regulation device in particular, a data interface, connected to the electronic control- or regulation device, for connection with a data transfer device of an external data processing device, wherein the program controlled electronic control- or regulation device is designed such that by means of the data processing unit, routines for performing operating processes of the handheld pipetting apparatus, on which the program controlled electronic control- or regulation device reverts, can be written into the write-read memory via the data interfaces.

15. A handheld pipetting apparatus according to claim 14, wherein the data interface has a radio sender or radio receiver or IR-sender or receiver for communication with corresponding senders or receivers of the data transfer device of the external data processing unit.

16. A handheld pipetting apparatus according to claim 14, wherein the non-volatile write-read memory is a flash memory of the micro computer or micro controller.

17. A handheld pipetting apparatus according to claim 14, wherein model specific programs or model specific parameters or user parameters can be written into the write-read memory or can be read out from the same, the handheld pipetting apparatus can be remote controlled.

18. A handheld pipetting apparatus according to claim 1, wherein the electronic analyzing unit is connected to an electronic display device, which indicates operation conditions and/or settings of the pipette depending of the tag which is read by the reading device.

* * * * *